US010077891B2

(12) United States Patent
Fortin

(10) Patent No.: US 10,077,891 B2
(45) Date of Patent: Sep. 18, 2018

(54) LUMINAIRE CONNECTION SYSTEMS

(71) Applicant: Fluxwerx Illumination Inc., Surrey (CA)

(72) Inventor: Daniel Fortin, New Westminster (CA)

(73) Assignee: Fluxwerx Illumination Inc., Surrey (CA)

( * ) Notice: Subject to any disclaimer, the term of this patent is extended or adjusted under 35 U.S.C. 154(b) by 0 days.

(21) Appl. No.: 15/184,836

(22) Filed: Jun. 16, 2016

(65) Prior Publication Data

US 2016/0369985 A1 Dec. 22, 2016

Related U.S. Application Data

(60) Provisional application No. 62/180,762, filed on Jun. 17, 2015.

(51) Int. Cl.

| | |
|---|---|
| ***F21S 4/00*** | (2016.01) |
| ***F21V 21/005*** | (2006.01) |
| *F21V 15/01* | (2006.01) |
| *F21V 15/015* | (2006.01) |

(52) U.S. Cl.

CPC ..... *F21V 21/005* (2013.01); *F21V 15/013* (2013.01); *F21V 15/015* (2013.01)

(58) Field of Classification Search

CPC ..... F21S 4/00; F21S 4/003; F21V 21/005; F21Y 2103/00

USPC ..... 362/219

See application file for complete search history.

(56) References Cited

U.S. PATENT DOCUMENTS

| | | | | |
|---|---|---|---|---|
| 7,401,942 | B1 * | 7/2008 | Verfuerth | F21S 8/06 362/217.05 |
| 2005/0041419 | A1 | 2/2005 | Kazi | |
| 2006/0158877 | A1 | 7/2006 | Lanczy | |
| 2015/0233533 | A1 * | 8/2015 | Van Es | F21K 9/175 313/49 |
| 2015/0338068 | A1 * | 11/2015 | Bolscher | F21V 21/005 362/219 |

FOREIGN PATENT DOCUMENTS

| | | | |
|---|---|---|---|
| DE | 1032397 | B | 6/1958 |
| DE | 202015100867 | U1 | 3/2015 |

* cited by examiner

*Primary Examiner* — Ahshik Kim

(74) *Attorney, Agent, or Firm* — Oyen Wiggs Green & Mutala LLP

(57) ABSTRACT

A system for connecting luminaires is provided. The system includes: a first luminaire having an end face having a first slot; a second luminaire having an end face having a second slot; a first elongated joining member having first prongs. The first slot and second slot are in laterally aligned and joined relationship define a first joining member slot having a first wedged end, and the first wedged end is shaped to provide an interference fit with the first prongs wherein advancing the first prongs against the first wedged end forces the first slot and the second slot toward each other to tighten connection between the first luminaire and the second luminaire.

17 Claims, 5 Drawing Sheets

LUMINAIRE CONNECTION SYSTEMS

TECHNICAL FIELD

This invention relates to luminaires, and in particular to systems for connecting luminaires together.

BACKGROUND

Spatial and design considerations can require two or more luminaires to be connected together in certain lighting environments. Systems for effectively connecting luminaires are desirable.

SUMMARY

The inventions described herein have many aspects, some of which relate to systems for connecting luminaries.

In one aspect, a system for connecting luminaires is provided. The system comprises: a first luminaire comprising an end face comprising a first slot; a second luminaire comprising an end face comprising a second slot; a first elongated joining member comprising first prongs. The first slot and second slot are in laterally aligned and joined relationship define a first joining member slot comprising a first wedged end, and the first wedged end is shaped to provide an interference fit with the first prongs wherein advancing the first prongs against the first wedged end forces the first slot and the second slot toward each other to tighten connection between the first luminaire and the second luminaire.

The first wedged end may comprise outwardly and downwardly angled surfaces that define a first angle equal to or greater than a second angle defined by the first prongs.

The first luminaire may comprise a first crossplate that at least partly defines the end face of the first luminaire, and the second luminaire may comprise a second crossplate that at least partly defines the end face of the second luminaire.

The first luminaire may comprise a pair of first sidewalls that at least partly defines the end face of the first luminaire, and the second luminaire may comprise a pair of second sidewalls that at least partly defines the end face of the second luminaire.

The first and second slots may be formed in the first and second crossplates.

The first slots may be formed in the first sidewalls and the second slots may be formed in the second sidewalls.

The first slots may be formed partly in the first crossplate and partly in the first sidewalls, and the second slots may be formed partly in the second crossplate and partly in the second sidewalls.

The first and second elongated joining members may extend into their respective joining member slots to a depth greater than half of the height of the sidewalls.

The system may comprise fastening means for fastening the first and second elongated joining members into their respective joining member slots. The fastening means may be selected from the group consisting of screws, snap clips and spring clips. The fastening means may comprise screws for fastening a flanged portion of the elongated first and second elongated joining members to the crossplates of the first and second luminaires.

A close tolerance may exist between a thickness of the first and second elongated joining members and a thickness of their respective joining member slots.

A loose tolerance may exist between a width of the first and second elongated joining members and a width of their respective joining member slots.

The system may comprise a plurality of opposing aligning slots formed in the end faces of the first and second luminaires, and a plurality of aligning members insertable in the aligning slots.

The first elongated joining member may be rigid and the first joining member slot may comprise a straight cross-section.

The first elongated joining member may be flexible and the first joining member slot may comprise a curved cross-section.

In another aspect a system for connecting luminaires is provided. The system comprises: a first luminaire comprising an end face comprising a first slot and a third slot; a second luminaire comprising an end face comprising a second slot and a fourth slot; a first elongated joining member comprising first prongs; and a second elongated joining member comprising second prongs. The first slot and second slot may be laterally aligned and joined relationship to define a first joining member slot comprising a first wedged end. The third slot and fourth slot may be in laterally aligned and joined relationship to define a second joining member slot comprising a second wedged end. The first wedged end may be shaped to provide an interference fit with the first prongs wherein advancing the first prongs against the first wedged end forces the first slot and the second slot toward each other to tighten connection between the first luminaire and the second luminaire. The second wedged end may be shaped to provide an interference fit with the second prongs wherein advancing the second prongs against the second wedged end forces the third slot and the fourth slot toward each other to tighten connection between the first luminaire and the second luminaire.

The first and second wedged ends may each comprise outwardly and downwardly angled surfaces that define a first angle equal to or greater than a second angle defined by the first and second prongs.

The first luminaire may comprise a first U-shaped crossplate comprising a pair of first legs that at least partly defines the end face of the first luminaire, and the second luminaire may comprise a second U-shaped crossplate comprising a pair of second legs that at least partly defines the end face of the second luminaire.

The first luminaire may comprise a pair of first sidewalls that at least partly defines the end face of the first luminaire, and the second luminaire may comprise a pair of second sidewalls that at least partly defines the end face of the second luminaire.

The first slots may be formed in the first legs and the second slots may be formed in the second legs.

The first slots may be formed in the first sidewalls and the second slots may be formed in the second sidewalls.

The first slots may be formed partly in the first legs and partly in the first sidewalls, and the second slots may be formed partly in the second legs and partly in the second sidewalls.

The first and second elongated joining members may extend into their respective joining member slots to a depth greater than half of the height of the sidewalls.

The system may comprise a fastening means for fastening the first and second elongated joining members into their respective joining member slots. The fastening means may be selected from the group consisting of screws, snap clips and spring clips. The fastening means may comprise screws for fastening a flanged portion of the elongated first and second elongated joining members to U-shaped crossplates of the first and second luminaires.

A close tolerance may exist between a thickness of the first and second elongated joining members and a thickness of their respective joining member slots.

A loose tolerance may exist between a width of the first and second elongated joining members and a width of their respective joining member slots.

A plurality of opposing aligning slots may be formed in the end faces of the first and second luminaires, and a plurality of aligning members may be insertable in the aligning slots.

The first elongated joining member may be rigid and the first joining member slot may comprise a straight cross-section.

The first elongated joining member may be flexible and the first joining member slot may comprise a curved cross-section.

The foregoing discussion merely summarizes certain aspects of the inventions and is not intended, nor should it be construed, as limiting the inventions in any way.

BRIEF DESCRIPTION OF DRAWINGS

The accompanying drawings illustrate non-limiting example embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

This invention relates to luminaires, and in particular to systems for connecting two luminaires together. Embodiments of the invention of exemplary commercial application are systems for end-to-end connection of elongated, channel-shaped luminaires. Examples of elongated, channel-shaped luminaires include the luminaires sold under the name PROFILE™ by Fluxwerx Illumination Inc. of Delta, British Columbia. Embodiments of the invention are also applicable to connecting luminaires of other shapes and in other configurations where a secure and discreet connection between luminaires, with connection components confined within relatively limited internal spaces of the luminaires, is sought; non-limiting examples include luminaires with curved sidewalls when viewed from above and below; and non-channel-shaped narrow luminaires such as the luminaires sold under the name VIEW™ by Fluxwerx Illumination Inc.

Claims of the invention relate to systems comprising a pronged joining member insertable into a corresponding joining member slot with a wedged end formed by respective slots of adjacent luminaires, wherein interference fit between the pronged joining member and the wedged end of the joining member slot provide an effective connection between the luminaires that is secure, discreet, and minimizes leakage of light from the boundary between the connected luminaires.

FIGS. 1 to 4 show a system 10 for connecting elongated channel-shaped luminaires 12 and 14 together according to an embodiment of the invention.

Figure 1:
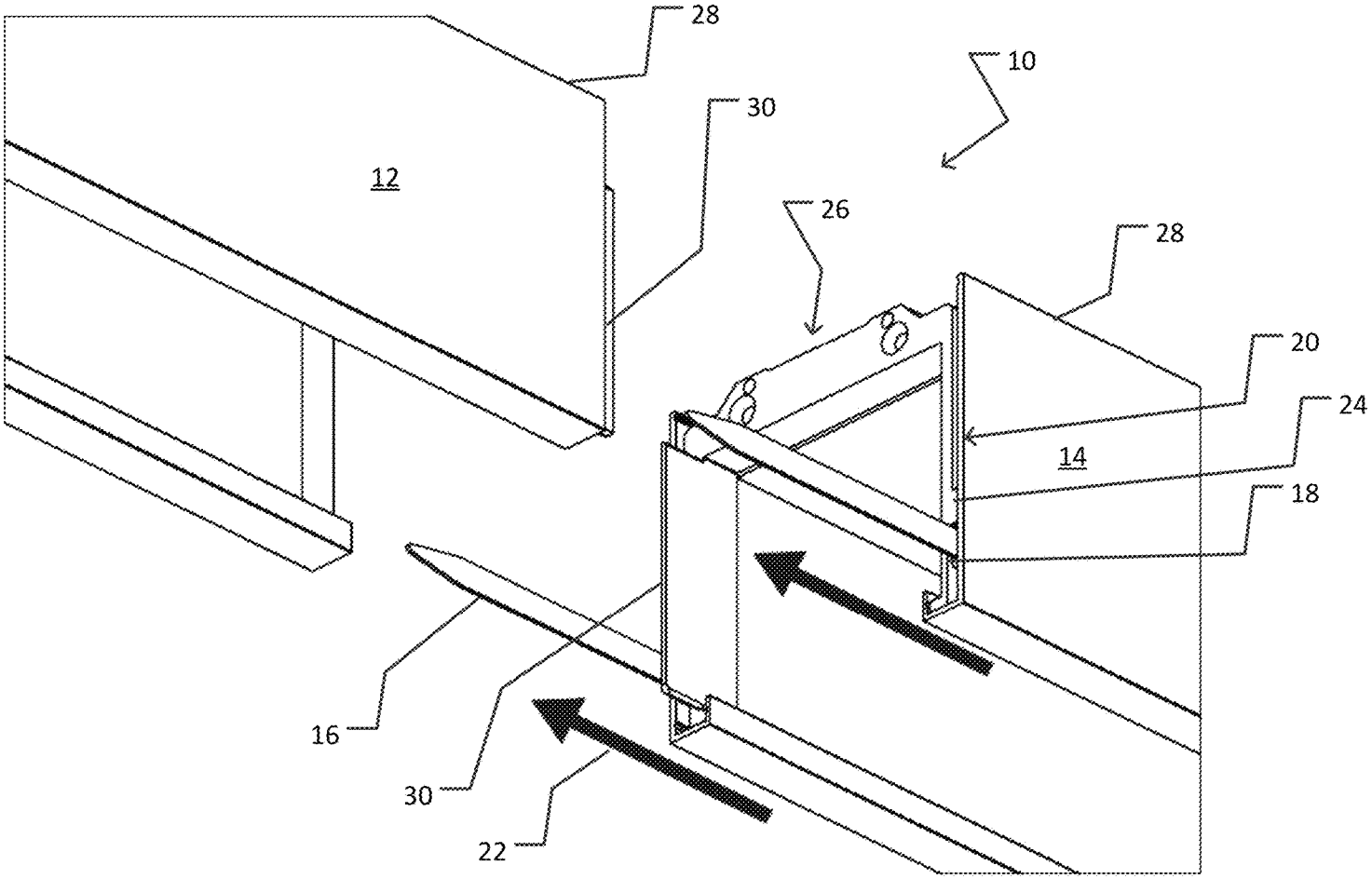
FIG. 1 is a bottom isometric view of a system according to an embodiment of the invention, showing two luminaires about to be connected.

FIG. 1 shows system 10 with aligning members 16 which insert into internal aligning slots 18 formed in end faces 20 of luminaires 12, 14 allowing luminaire 14 to be connected to luminaire 12, in for example the direction of arrow 22, in an end-to-end manner. System 10 is shown with two aligning members 16. Some embodiments may have only one aligning member 16 or more than two aligning members 16, with a corresponding number of aligning slots 18. In some embodiments, instead of having aligning slots 18 formed in end faces 20 of both luminaires 12 and 14, aligning slots 18 may be formed in end face 20 of one of the luminaires, with aligning members 16 fixed to and projecting from the other one of the luminaires. In some embodiments aligning members 16 and aligning slots 18 may be absent. In some embodiments other suitable features with similar function may be provided. In some embodiments end faces 20, including aligning slots 18, may be at least partially defined by legs 24 of crossplates 26 and/or sidewalls 28.

In some embodiments, plates 30 bridging the interior cavities of luminaires 12, 14 may be provided. Plates 30 block light that may otherwise escape from the lit interior cavities of luminaires 12, 14 to between the exterior connecting seam 32 between sidewalls 28 of luminaires 12, 14. Plates 30 also cover the internal connecting seam between luminaires 12,14, providing an aesthetically pleasing joint.

Figure 2:
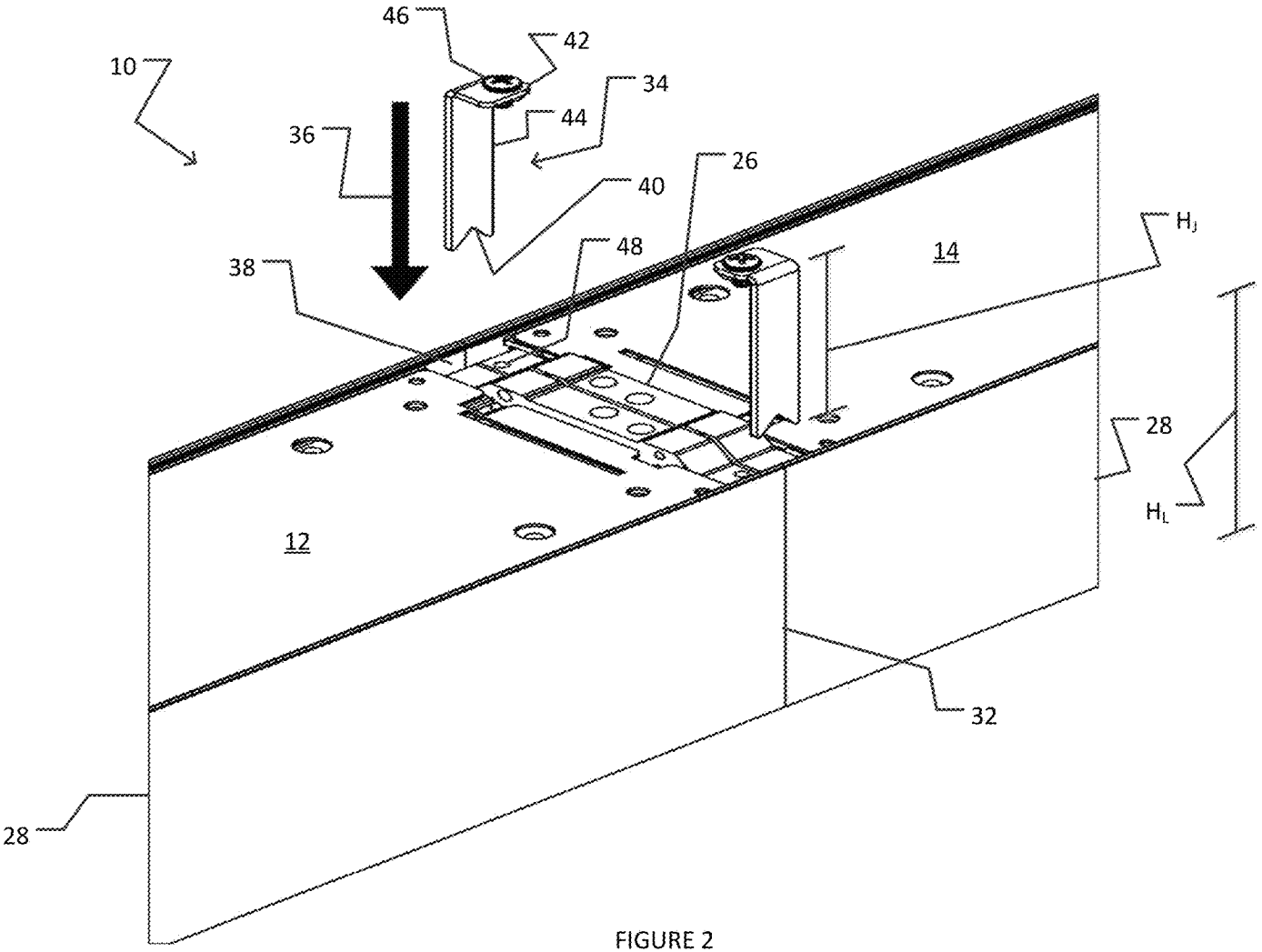
FIG. 2 is a top isometric view of the embodiment shown in FIG. 1, showing two luminaires connected.
Figure 3:
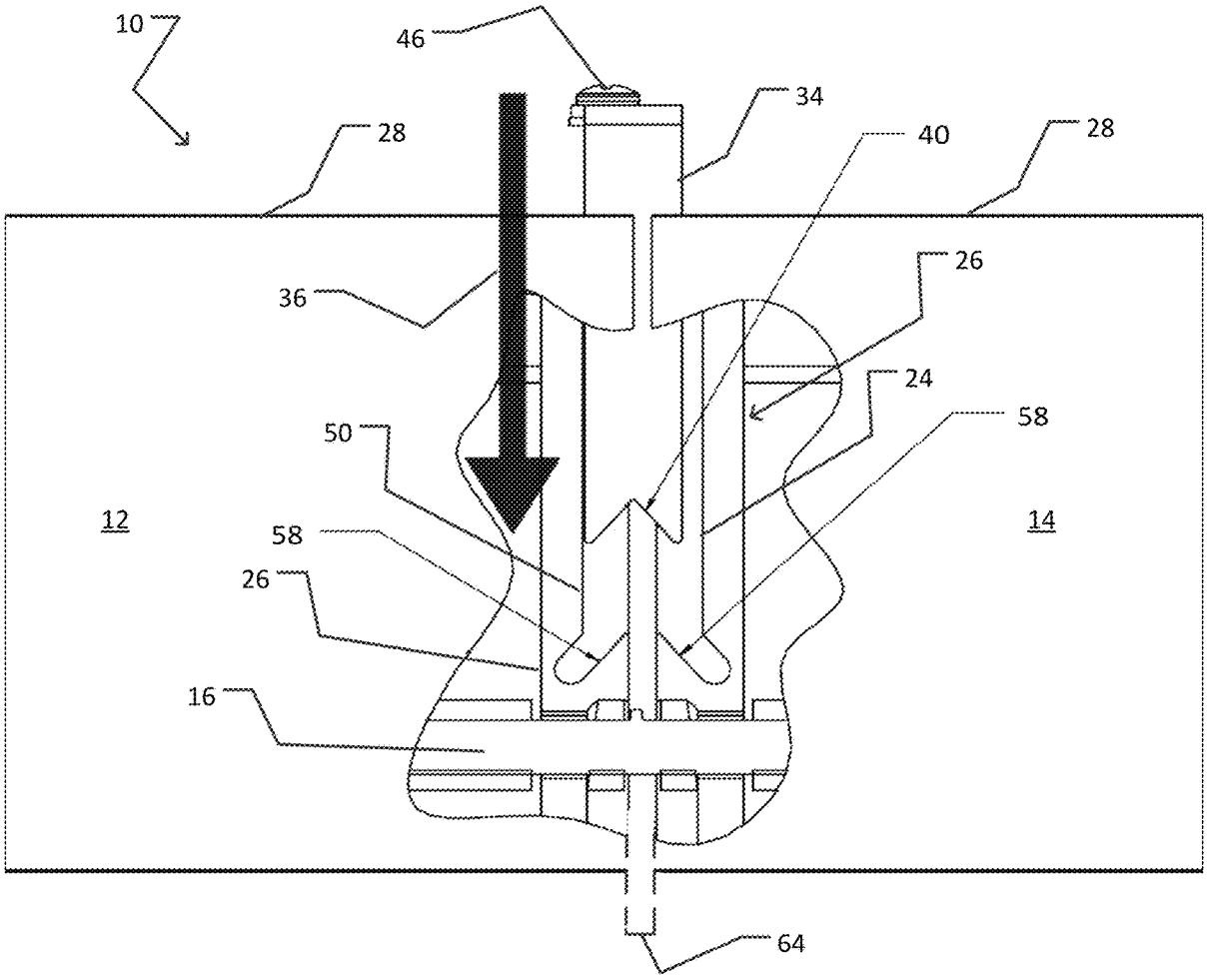
FIG. 3 is a cutaway partial side view of the embodiment shown in FIG. 1 showing insertion of a joining member into a joining member slot to secure connection between the luminaires.

FIGS. 2 to 4 show system 10 with joining members 34 and joining member slots 38. Joining members 34 and joining member slots 38 may be formed of any strong and durable material such as stainless steel, aluminum alloys, or the like. Joining members 34 are insertable in direction 36 into joining member slots 38 to secure the connection between luminaires 12, 14. In some embodiments the joining members may be rigid, for insertion into joining member slots with straight cross-sections (such as those illustrated in the Figures), for example in luminaires with straight sidewalls. In some embodiments the joining members may be flexible (e.g. made of a material such as spring steel), for insertion into joining member slots with curved cross-sections, for example in luminaires with curved sidewalls.

Joining member 34 includes prongs 40 at one end, an elongated body 44, and a perpendicular flange 42 at the other end. Flange 42 may include fastening means 46 for fastening joining member 34 to luminaires 12,14 once joining member 34 is fully inserted into joining member slot 38. In the illustrated embodiment, fastening means 46 comprises a screw extending through an aperture in flange 42 for engagement with a threaded bore 48 in crossplate 26 of luminaire 12 or 14. In some embodiments fastening means 46 may comprise two screws, each extending through a respective aperture in flange 42 and engaging a respective threaded bore 48 in crossplates 26 of each of luminaires 12,14. In some embodiments, any other suitable fastening means 46 may be employed to secure joining member 34 within joining member slot 38 and, depending on the fastening means 46, flange 42 may or may not be present. For example, a snap clip or a spring clip may be used to secure joining member 34 within joining member slot 38.

In some embodiments the length $L_J$ of joining member 34 may be greater than 50%, or greater than 75%, or greater than 90%, of the height $H_L$ of luminaires 12, 14, in order to ensure a secure connection between luminaires 12,14 and also to block light that may otherwise escape from an interior of luminaires 12, 14 and out connecting seam 32 between sidewalls 28 of luminaires 12, 14.

Figure 4A:
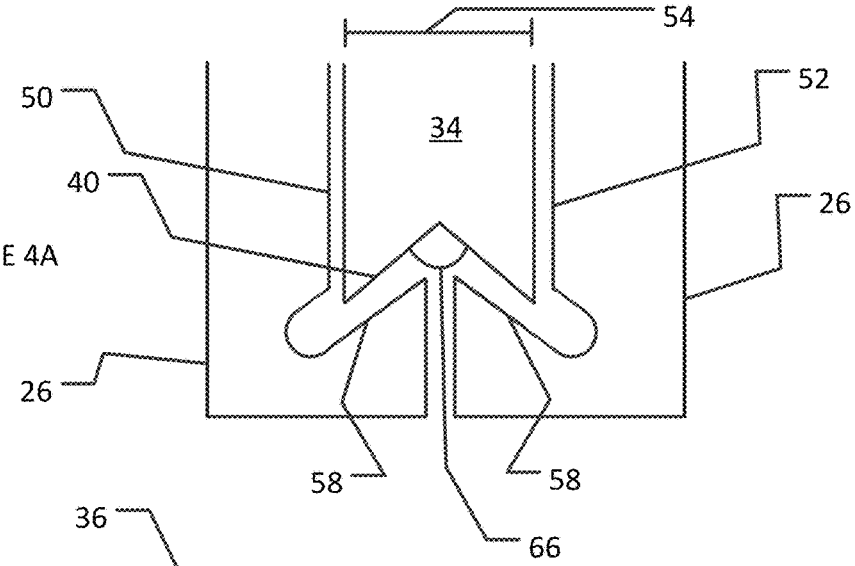
FIGS. 4A to 4C are a close up internal partial side views of the embodiment shown in FIG. 1 showing stages of insertion of the joining member into the joining member slot.
Figure 4B:
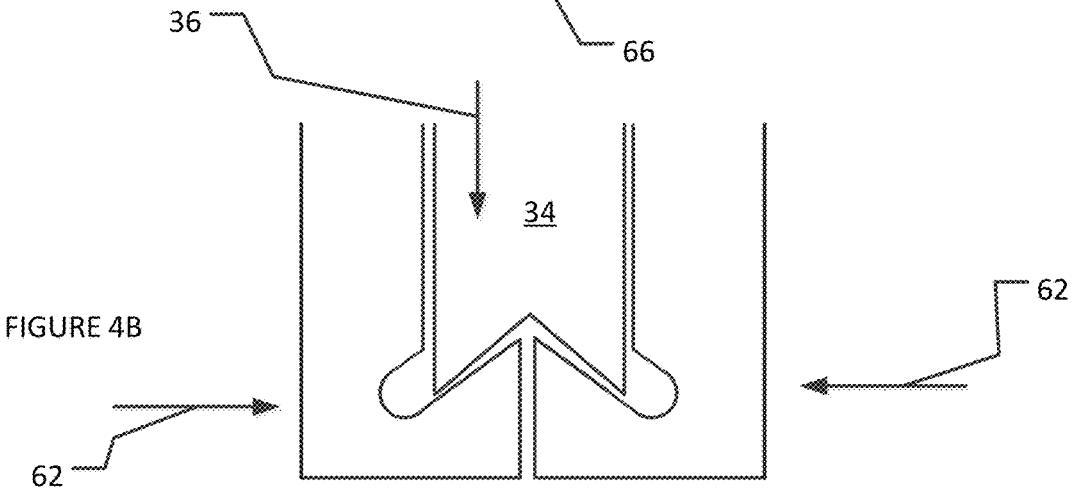
Figure 4C:
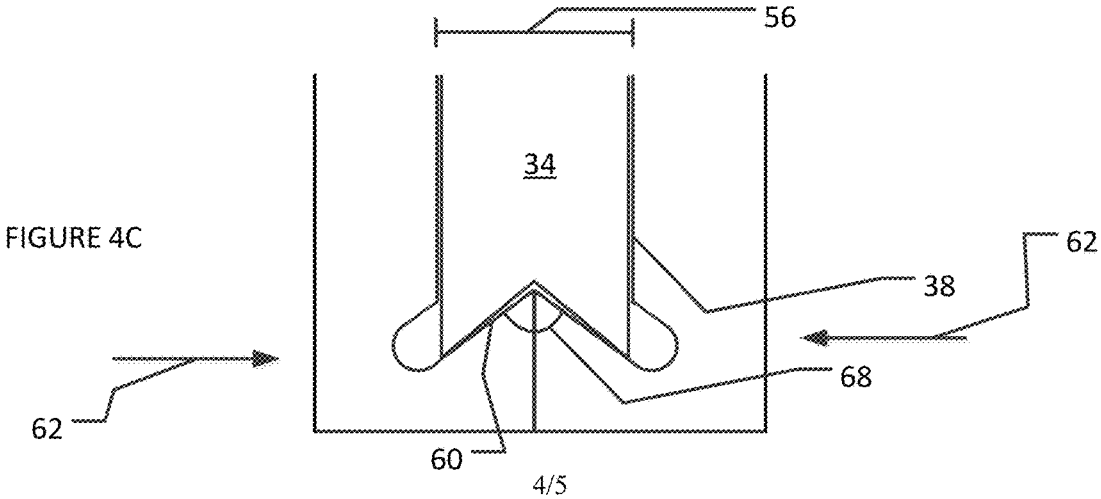

Joining member slot 38 is formed by lateral alignment and joining of slot 50 of luminaire 12 and slot 52 of luminaire 14, as shown best in FIGS. 4A to 4C. Joining member 34 is slidably insertable in joining member slot 38. In some embodiments, a close tolerance exists between the thickness of joining member 34 and the thickness of joining member slot 38, where thickness is defined as the dimension going toward and away from the drawing sheet with respect to FIGS. 3 and 4A to 4C. In some embodiments, a loose tolerance exists between a width 54 of joining member 34 and a width 56 of joining member slot 38.

As joining member 34 is initially inserted, there is typically a gap 64 between slots 50,52. Prongs 40 of joining member 34 eventually contacts sloped surfaces 58 of respective slots 50,52 and due to the configuration and interaction of these components, gap 64 closes, as shown in FIGS. 4A to 4C and described as follows.

Sloped surfaces 58 of slots 50,52 are angled outwardly and downwardly. Sloped surfaces 58, upon lateral alignment and joining of slots 50, 52, form wedged end 60. Wedged end 60 and prongs 40 are shaped to provide an interference fit between them, such that as prongs 40 advance downward in direction 36, slots 50, 52 are forced together in direction 62 to form joining member slot 38, thereby tightening the connection between luminaires 12, 14 and eliminating any gap 64. In other words, as joining member 34 is pushed down slots 50,52, the force (e.g. downward force) along direction 36 is translated to forces (e.g. lateral forces) along directions 62 to secure luminaires 12, 14 together. Interference fit is provided by having angle 68 defined by wedged end 60 be equal to or greater than angle 66 defined by prongs 40. In the illustrated embodiment, angle 68 is greater than angle 66.

Slots 50,52 are formed in end faces 20 of luminaires 12, 14. As described above, end faces 20 may be at least partially defined by legs 24 of crossplates 26 and/or the ends of sidewalls 28. Accordingly, in some embodiments, slots 50, 52 may be at least partially formed in legs 24 of crossplates 26 and/or in the ends of sidewalls 28. In the illustrated embodiment, slots 50, 52 are formed in legs 24 of crossplates 26. In some embodiments slots 50,52, and therefore wedged end 60, may be symmetrical. In some embodiments slots 50,52, and therefore wedged end 60, may be non-symmetrical.

Accordingly, reducing and eliminating gap 16 has the advantage of increasing the aesthetic appeal of luminaires 12 and 14 and giving them a seamless appearance. Placing joining member 34 into joining member slot 38 in the crossplates 26 and/or sidewalls 28 of luminaires 12 and 14, where joining member 34 is not visible, also has this advantage.

In some embodiments, the interference fit may be provided by other suitable shapes and configurations of the prongs and the wedged ends. FIGS. 5A, 5B, 6A and 6B illustrate examples of such other shapes and configurations.

Figure 5A:
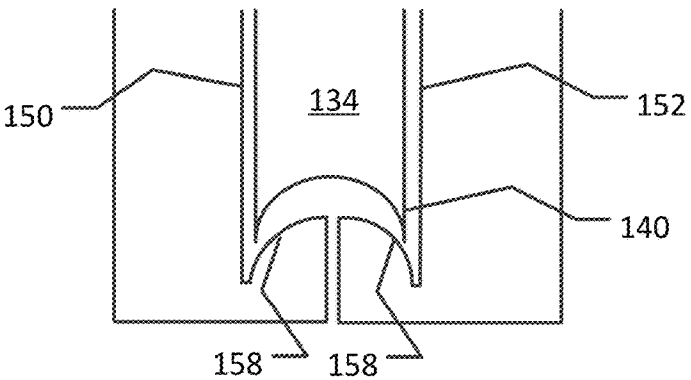
FIGS. 5A and 5B show close up internal partial side views of a joining member and a joining member slot according to another embodiment of the invention.
Figure 5B:
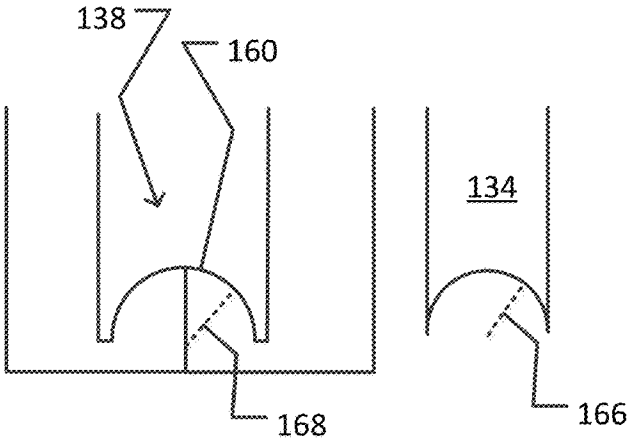

FIGS. 5A and 5B show joining member 134 with prongs 140, slots 150, 152 (which join to form joining member slot 138 and round end 160) with sloped surfaces 158 curving outwardly and downwardly. The radius 168 defined by round end 160 is equal to or greater than the radius 166 defined by prongs 140 to provide an interference fit between round end 160 and prongs 140.

Figure 6A:
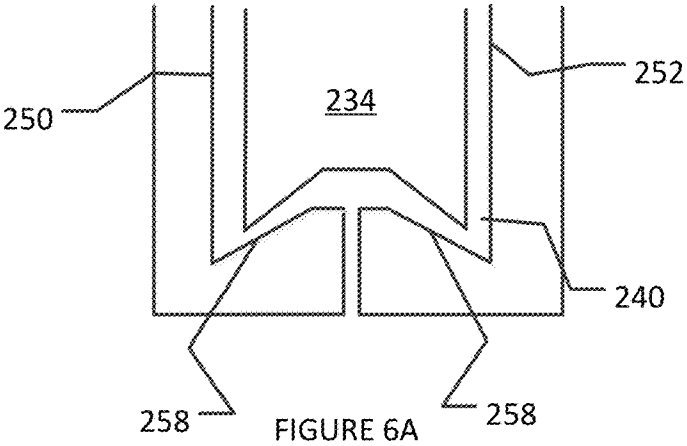
FIGS. 6A and 6B show close up internal partial side views of a joining member and a joining member slot according to another embodiment of the invention.
Figure 6B:
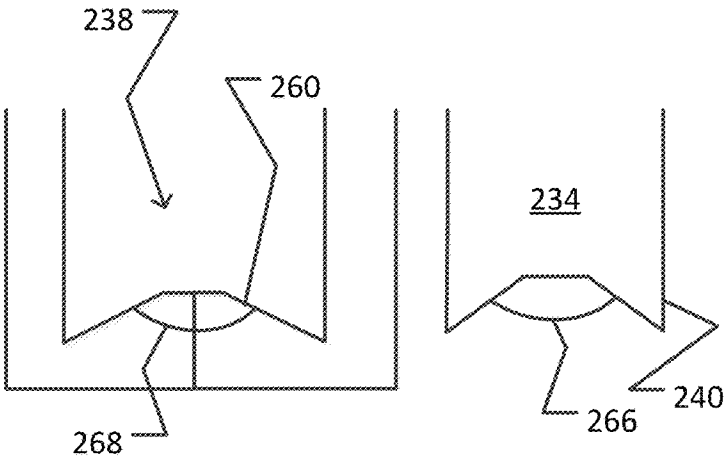

FIGS. 6A and 6B show joining member 234 with prongs 240, slots 250, 252 (which join to form joining member slot 238 and wedged end 260) with sloped surfaces 258 angling outwardly and downwardly. The angle 268 defined by wedged end 260 is equal to or greater than the angle 266 defined by prongs 240 to provide an interference fit between wedged end 260 and prongs 240.

Where a component (e.g. joining fork, luminaire, etc.) is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments of the invention.

This application is intended to cover any variations, uses, or adaptations of the invention using its general principles. Further, this application is intended to cover such departures from the present disclosure as come within known or customary practice in the art to which this invention pertains and which fall within the limits of the appended claims. Accordingly, the scope of the claims should not be limited by the preferred embodiments set forth in the description, but should be given the broadest interpretation consistent with the description as a whole.

The invention claimed is:

1. A system for connecting luminaires, the system comprising:

a first luminaire comprising an end face comprising a first slot;

a second luminaire comprising an end face comprising a second slot;

a first elongated joining member comprising first prongs;

wherein the first slot and second slot in laterally aligned and joined relationship define a first joining member slot comprising a first wedged end, wherein the first wedged end is shaped to provide an interference fit with the first prongs wherein advancing the first prongs against the first wedged end forces the first slot and the second slot toward each other to tighten connection between the first luminaire and the second luminaire.

2. A system according to claim 1 wherein the first wedged end comprises outwardly and downwardly angled surfaces that define a first angle equal to or greater than a second angle defined by the first prongs.

3. A system according to claim 2 wherein:

the first luminaire comprises a first crossplate that at least partly defines the end face of the first luminaire; and the second luminaire comprises a second crossplate that at least partly defines the end face of the second luminaire.

4. A system according to claim 3 wherein:

the first luminaire comprises a pair of first sidewalls that at least partly defines the end face of the first luminaire; and the second luminaire comprises a pair of second sidewalls that at least partly defines the end face of the second luminaire.

5. A system according to claim 3 wherein the first and second slots are formed in the first and second crossplates.

6. A system according to claim 4 wherein the first slots are formed in the first sidewalls and the second slots are formed in the second sidewalls.

7. A system according to claim 4 wherein the first slots are formed partly in the first crossplate and partly in the first sidewalls, and the second slots are formed partly in the second crossplate and partly in the second sidewalls.

8. A system according to claim 5 wherein the first elongated joining member extends into the first joining member slot to a depth greater than half of the height of the sidewalls.

9. A system according to claim 8 comprising fastening means for fastening the first elongated joining member into the first joining member slot.

10. A system according to claim 9 wherein the fastening means is selected from the group consisting of screws, snap clips and spring clips.

11. A system according to claim 10 wherein the fastening means comprise screws for fastening a flanged portion of the first elongated joining member to the crossplates of the first or second luminaire.

12. A system according to claim 11 wherein a close tolerance exists between a thickness of the first elongated joining member and a thickness of the first joining member slot.

13. A system according to claim 12 wherein a loose tolerance exists between a width of the first elongated joining member and a width of the first joining member slot.

14. A system according to claim 13 comprising:

a plurality of opposing aligning slots formed in the end faces of the first and second luminaires; and a plurality of aligning members insertable in the aligning slots.

15. A system according to claim 14 wherein the first elongated joining member is rigid and the first joining member slot comprises a straight cross-section.

16. A system according to claim 14 wherein the first elongated joining member is flexible and the first joining member slot comprises a curved cross-section.

17. A system for connecting luminaires, the system comprising:

a first luminaire comprising an end face comprising a first slot and a third slot;

a second luminaire comprising an end face comprising a second slot and a fourth slot;

a first elongated joining member comprising first prongs;

a second elongated joining member comprising second prongs;

wherein the first slot and second slot in laterally aligned and joined relationship define a first joining member slot comprising a first wedged end, wherein the third slot and fourth slot in laterally aligned and joined relationship define a second joining member slot comprising a second wedged end, wherein the first wedged end is shaped to provide an interference fit with the first prongs wherein advancing the first prongs against the first wedged end forces the first slot and the second slot toward each other to tighten connection between the first luminaire and the second luminaire; and wherein the second wedged end is shaped to provide an interference fit with the second prongs wherein advancing the second prongs against the second wedged end forces the third slot and the fourth slot toward each other to tighten connection between the first luminaire and the second luminaire.

* * * * *